US006112858A

United States Patent [19]

Arnst

[11] Patent Number: 6,112,858

[45] Date of Patent: Sep. 5, 2000

[54] ASSEMBLY LINE FIXTURE

[75] Inventor: Michael L. Arnst, Bonner Springs, Kans.

[73] Assignee: Harley-Davidson Motor Company, Milwaukee, Wis.

[21] Appl. No.: 09/120,098

[22] Filed: Jul. 21, 1998

[51] Int. Cl.[7] ..... B66B 9/02

[52] U.S. Cl. ..... 187/269; 187/244; 104/44; 269/9 C; 269/134; 74/813 R; 74/813 L

[58] Field of Search ..... 104/35, 44, 47; 269/8 C, 9 C, 122, 124, 134; 414/744.7, 589, 590; 108/20, 21, 22; 74/813 R, 813 L, 527; 187/211, 218, 219, 240, 242, 244, 269

[56] References Cited

U.S. PATENT DOCUMENTS

| | | | |
|---|---|---|---|
| 860,778 | 7/1907 | Whiteman | 269/8 C |
| 2,044,031 | 6/1936 | Van Nieuwland | 104/44 |
| 2,885,915 | 5/1959 | Schurger | 74/813 |
| 3,094,885 | 6/1963 | Flannery et al. | 74/813 |
| 3,170,411 | 2/1965 | Howard | 104/44 |
| 3,177,740 | 4/1965 | Firestone et al. | 74/813 |
| 3,418,943 | 12/1968 | Teters | 104/44 |
| 3,618,427 | 11/1971 | Schoepe | 74/813 L |
| 3,718,055 | 2/1973 | Maier | 74/813 L |
| 3,724,291 | 4/1973 | Goebel | 74/813 L |
| 3,802,297 | 4/1974 | Schiler | 74/813 L |
| 3,848,863 | 11/1974 | Owen | 269/9 C |
| 3,850,051 | 11/1974 | Woltjen et al. | 74/813 L |
| 3,913,417 | 10/1975 | Vangor | 74/813 L |
| 4,572,017 | 2/1986 | Rossi | 108/21 |
| 4,669,948 | 6/1987 | Moller | 414/590 |
| 5,090,508 | 2/1992 | Nishikawa | 187/211 |
| 5,467,561 | 11/1995 | Takaoka | 187/266 X |
| 5,490,758 | 2/1996 | Stone | 414/495 X |
| 5,582,112 | 12/1996 | Huang | 108/22 |
| 5,595,124 | 1/1997 | Wixey et al. | 108/22 X |
| 5,626,079 | 5/1997 | Summers | 104/44 |
| 5,782,602 | 7/1998 | Mehta et al. | 187/253 X |
| 5,784,932 | 7/1998 | Gillerti | 74/813 R |
| 5,829,948 | 11/1998 | BEcklund | 187/269 X |
| 5,862,718 | 1/1999 | Kiesling | 74/813 L |

*Primary Examiner*—Robert P. Olszewski
*Assistant Examiner*—Thuy V. Tran
*Attorney, Agent, or Firm*—Michael Best & Friedrich LLP

[57] ABSTRACT

An assembly line fixture includes an elevator having a mounting surface, and a turntable mounted on the mounting surface and rotatable about an axis of rotation with respect to the mounting surface. Also mounted on the mounting surface are a detent mechanism, a locking mechanism, and a clamping mechanism. The detent mechanism includes a roller that is spring biased against the turntable, and that is operable to resist rotation of the turntable at preselected angular positions. The locking mechanism includes a lever, a locking member, and a biasing member. The locking member engages notches in the turntable to prevent the turntable from rotating. The lever actuates the locking member and the biasing member biases the locking member toward the notches for engagement therewith. The clamping mechanism includes at least one clamp that is adapted to engage a portion of an apparatus. The clamping mechanism also includes a clamp-actuating mechanism that causes the clamp to close or open to respectively engage and disengage a portion of an apparatus.

17 Claims, 9 Drawing Sheets

218
222
210
226
234
82
166
214
230

ASSEMBLY LINE FIXTURE

FIELD OF THE INVENTION

The invention relates to fixtures for use in assembly lines.

BACKGROUND OF THE INVENTION

Industries that manufacture complex apparatuses or machinery, such as automobiles, motorcycles, engines, and the like, often use an assembly line to most efficiently assembly the apparatuses. These assembly lines often take up large amounts of space and create the need for a relatively large facility in which the apparatuses are assembled.

SUMMARY OF THE INVENTION

The present invention provides an assembly line fixture for use in assembling an apparatus (e.g., a motorcycle). The fixture includes an elevator having a mounting surface, and operable to raise and lower the mounting surface with respect to an assembly line floor. Mounted on the mounting surface is a turntable having a tabletop. The turntable rotates with respect to the mounting surface on a plurality of bearings that abut the underside of the tabletop.

A skirt depends from the tabletop, and substantially surrounds the periphery of the tabletop. The skirt includes a plurality of apertures spaced apart from each other at selected angular positions. A detent member engages the apertures to temporarily prevent the turntable from rotating with respect to the mounting surface. In this manner, the apparatus may be retained at a selected known angle of rotation with respect to the mounting surface while selected apparatus parts are installed or machined. An inner surface of the skirt includes a series of notches. A locking mechanism is provided that engages the notches in the skirt to firmly fix the turntable against rotation with respect to the mounting surface.

Mounted on a top surface of the tabletop is at least one clamp that is adapted to engage a portion of the apparatus (e.g., the frame of a motorcycle). A clamp-actuating mechanism is provided that causes the clamp to engage and disengage a portion of the apparatus. In one aspect of the invention, the clamp-actuating mechanism includes a shaft that is threadedly received in the clamp to move a portion of the clamp in reaction to rotation of the shaft. In another aspect of the invention, the clamp-actuating mechanism includes a cross-member that is pivoted by rotation of a lever to cause link members to open or close the clamp.

The fixture is easily moved along an assembly line on wheels or other means of transportation. The fixture takes up relatively little space in the assembly facility and is relatively easy to manipulate by an assembly line operator by way of foot peddles.

DETAILED DESCRIPTION

Figure 1:
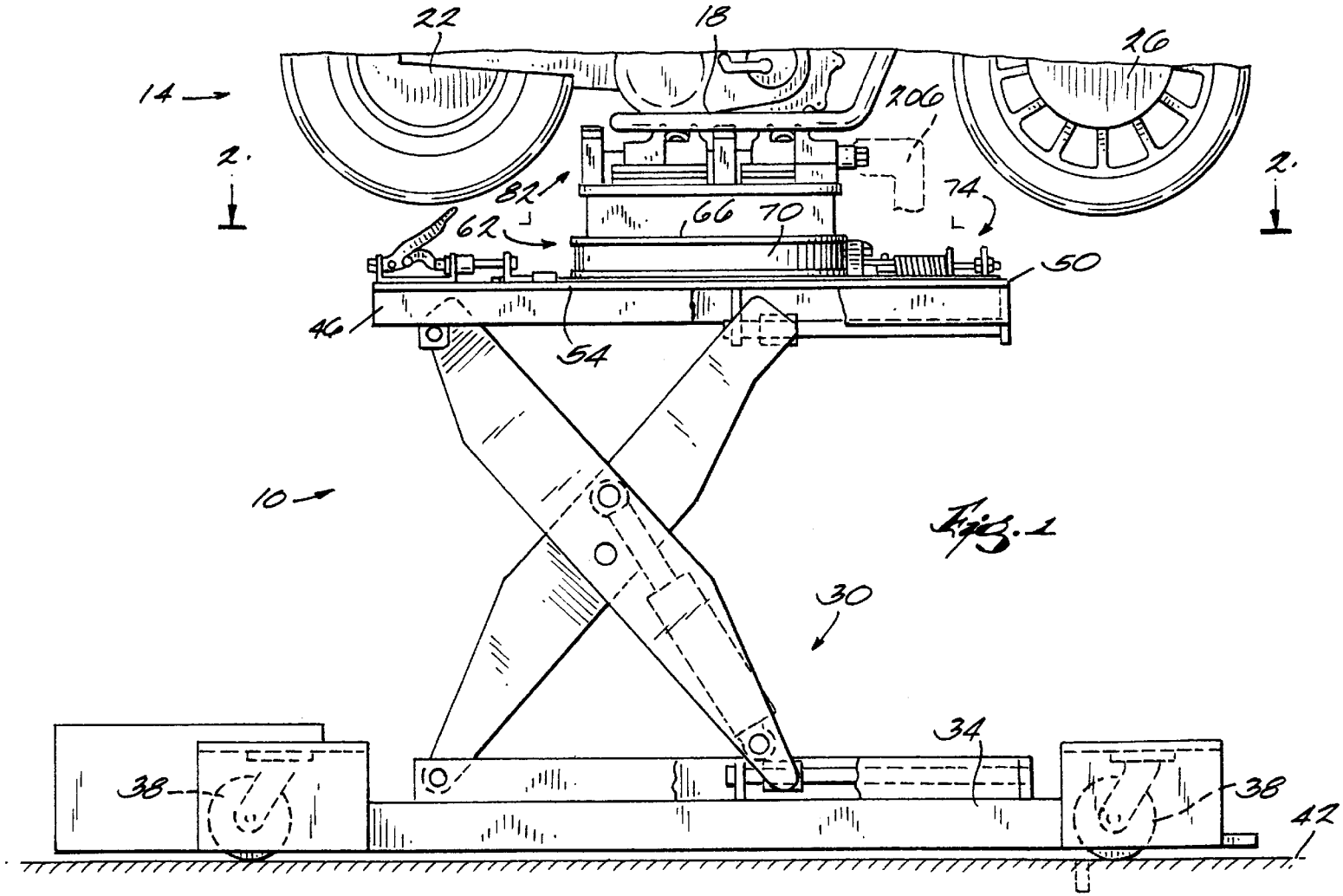
FIG. 1 is a side elevational view of the fixture according to the present invention.

FIG. 1 illustrates an assembly line fixture 10 supporting an apparatus 14 that has been assembled thereon. The illustrated apparatus is a motorcycle having a frame 18, a rear wheel 22, and a front wheel 26. The fixture 10 includes an elevator 30, which in the illustrated embodiment is either a pneumatic or an hydraulic scissor-leg table. The elevator 30 is mounted on a pallet or slab 34, which is supported by means for transporting the fixture 38, such as wheels. In this regard, the fixture 10 is movable along an assembly line floor 42.

Figure 2:
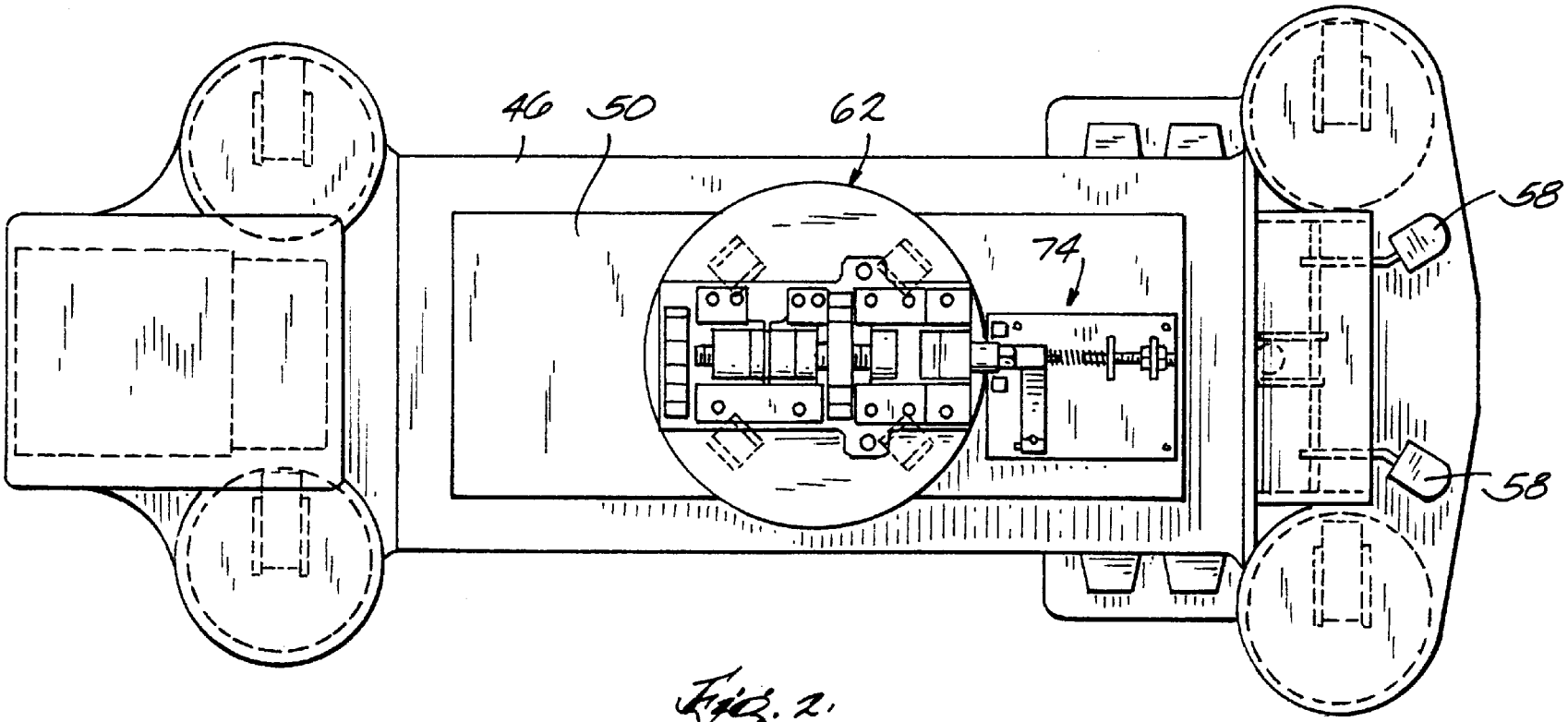
FIG. 2 is a top plan view of the fixture taken along line 2—2 in FIG. 1.

The elevator 30 includes a platform 46, which is illustrated as being generally horizontally disposed, but which may also be disposed at an angle with respect to the assembly line floor 42. The platform 46 includes a top surface or a mounting surface 50 and a bottom surface 54. The elevator 30 is operable to raise and lower the platform 46 with respect to the assembly line floor 42. Foot peddles 58 (FIG. 2) are provided to facilitate operating the elevator 30.

The fixture 10 also includes a turntable 62 mounted on the mounting surface 50. The turntable 62 includes a tabletop 66 and a skirt 70 substantially surrounding the tabletop 66. Also mounted on the platform 46 are a detent mechanism 74, a locking mechanism 78, and a clamping mechanism 82.

Figure 3:
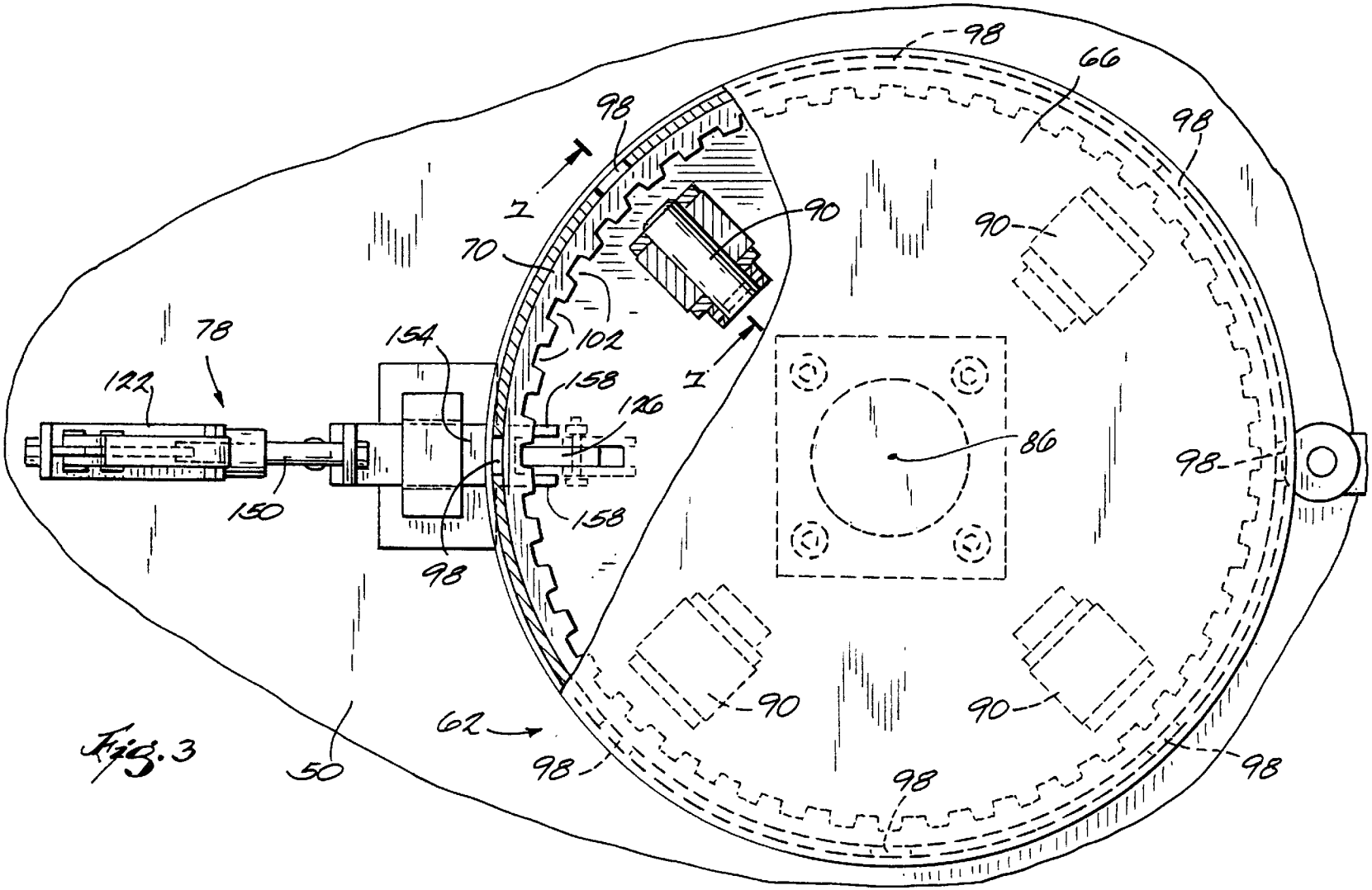
FIG. 3 is a top plan view of the fixture with some portions removed for the purpose of illustration.
Figure 7:
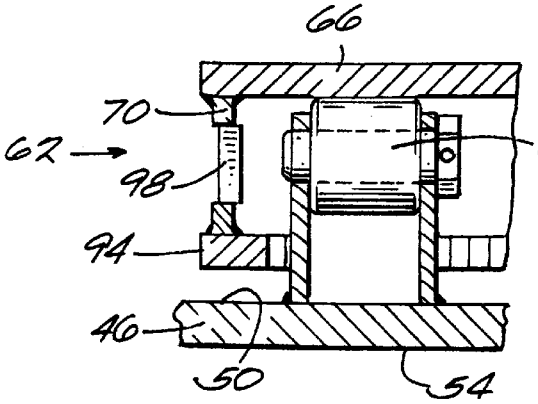
FIG. 7 is a side elevational view of a bearing.

With reference to FIGS. 3 and 7, the turntable 62 is supported for rotation about an axis of rotation 86 (extending perpendicular to the page in FIG. 3) by a plurality of bearings 90. The illustrated bearings 90 are mounted on the mounting surface 50 and engage the underside of the tabletop 66. A flange 94 defining a guide may be provided in the turntable 62 or on the mounting surface 50 to ensure the turntable 62 rotates substantially about the axis of rotation 86 on the bearings 90. The skirt 70 includes a number of apertures 98 at selected angular intervals (every 45° in the illustrated embodiment) around the skirt's circumference. The skirt 70 also includes a series of notches 102 along its inner surface. The skirt 70 may be provided as a piece that is separate from the tabletop 66, or may be formed integrally with the tabletop 66.

Figure 4:
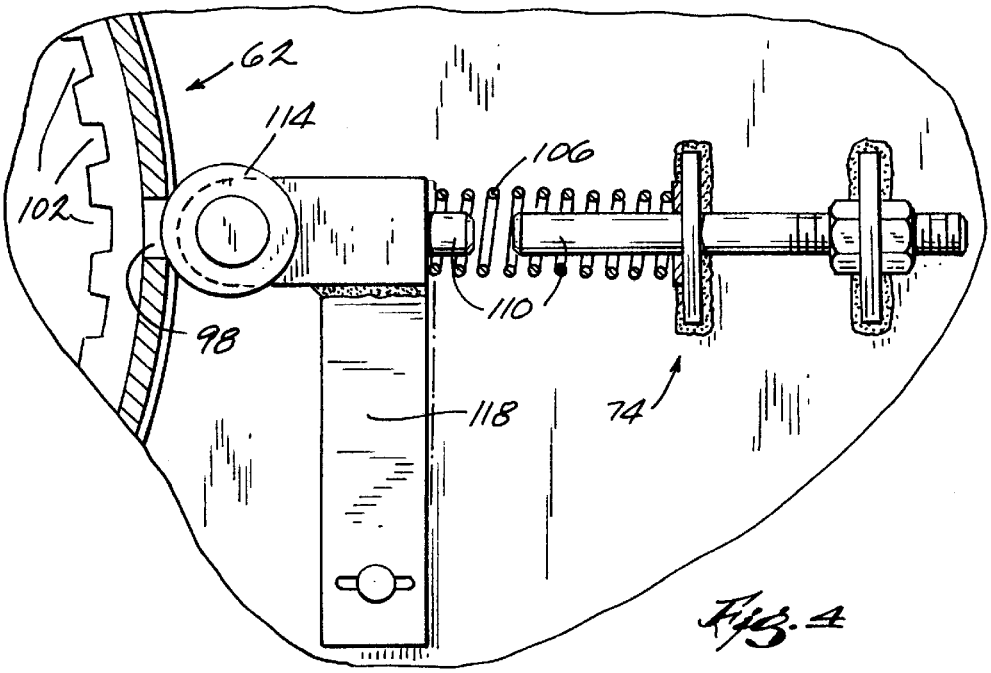
FIG. 4 is a top plan view of the detent mechanism.
Figure 5:
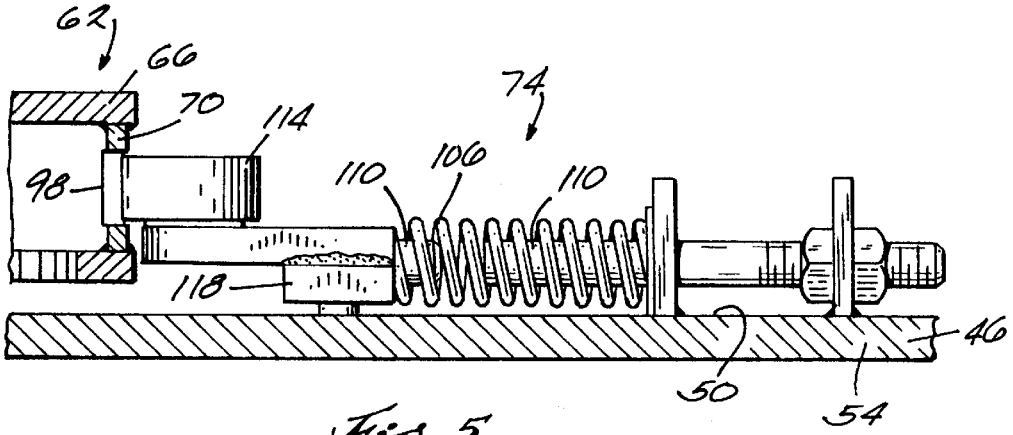
FIG. 5 is a side elevational view of the detent mechanism.

Referring now to FIGS. 4 and 5, the detent mechanism 74 operates to temporarily restrain the turntable 62 at selected angular positions. In the illustrated embodiment, the detent mechanism 74 includes a first biasing member 106, a two-piece shaft 110, and a roller 114. The roller 114 is biased against the outer surface of the skirt 70 of the turntable 62 by the first biasing member 106, which in the illustrated embodiment is a spring. The detent mechanism 74 also includes a swing arm 118 that maintains the roller 114 in proper alignment with the two-piece shaft 110 and the first biasing member 106. The swing arm 118 is pivotally mounted on the mounting surface 50.

In operation, as the turntable 62 is rotated, the roller 114 rolls along the outer surface of the skirt 70 until it encounters an aperture 98. Then the roller 114 is thrust into the aperture 98 by the biasing force of the first biasing member 106. The roller 114 thus received in the aperture 98 resists further rotation of the turntable 62. The roller 114 is disengaged from the aperture 98 by manually rotating the swing arm 118 to move the roller 114 away from the aperture 98, or by rotating the turntable 62 with sufficient force to cause the roller 114 to roll out of the aperture 98 against the biasing force of the first biasing member 106. In alternative embodiments of the invention, the detent mechanism 74 may be provided within in the skirt 70, and may include a roller 114 that operates on the inner surface of the skirt 70.

Figure 6:
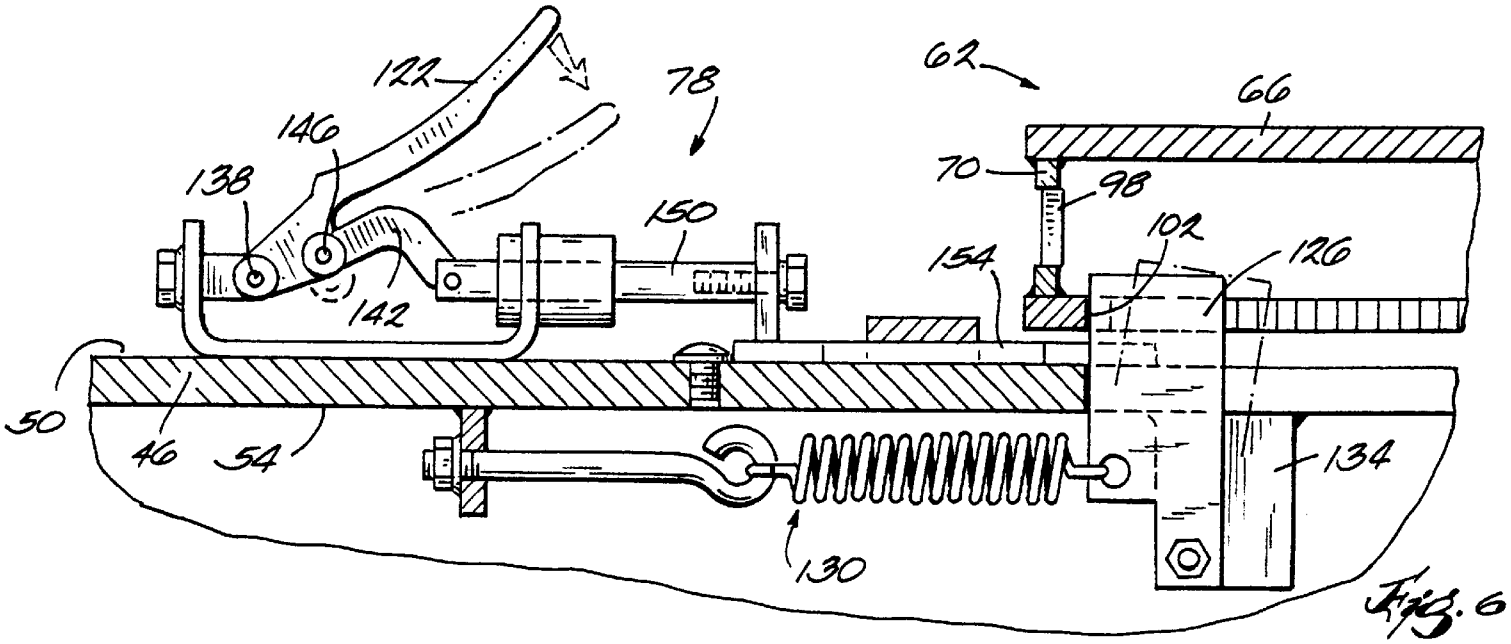
FIG. 6 is a side elevational view of the locking mechanism.

Referring now to FIGS. 3 and 6, the locking mechanism 78 includes a lever 122, a locking member 126, and a second biasing member 130. The locking member 126 is pivotally interconnected with a flange 134 mounted on the bottom surface of the platform 46, and is biased toward a locking position (illustrated in solid lines in FIG. 6) by way of the second biasing member 130. The illustrated second biasing member 130 is a spring and eye-bolt mounted to the bottom surface of the platform 46. The locking member 126 is received in one of the notches 102 when it is in the locking position, thereby preventing rotation of the turntable 62.

In the illustrated embodiment, the lever 122 is an over-center lever pivotal about a first pivot point 138 on the platform 46, and pivotal from an up position illustrated in solid lines (FIG. 6) to a down position illustrated in phantom. The over-center lever 122 is designed to remain locked in place when the lever 122 is moved into a down position shown in phantom in FIG. 6. A linkage, including a bent link 142 that is hingedly interconnected to the lever 122 at a second pivot point 146; a shaft 150, having a longitudinal axis, that is pivotally interconnected to the bent link 142, and which moves axially in reaction to rotation of the bent link 142; and an abutment member 154, operate to move the locking member 126 away from the skirt 70 when the lever 122 is in the down position. The shaft 150 is supported by a sleeve bearing to allow for axial movement of the shaft 150 in response to rotation of the lever 122. In the illustrated embodiment, the abutment member 154 is a fork having two prongs 158 that abut opposite side extensions of the locking member 126.

In operation, the lever 122 is moved to the down position to cause the locking member 126 to pivot out of engagement with the notches 102. Then the turntable 62 is rotated until the desired angular setting is achieved, at which time the lever 122 is rotated to the up position to allow the biased locking member 126 to engage the notch 102 with which it is aligned. The second biasing member 130 assists in returning the lever 122 to the up position when the lever 122 is rotated enough to place the second pivot point 146 just over the line of force defined by the longitudinal axis of the shaft 150.

The locking mechanism 78 may be used in conjunction with the detent mechanism 74 to quickly position the turntable 62 at a desired angular rotation (e.g., in increments of 45°) for installing or machining certain parts of the apparatus 14, and to lock the turntable 62 in that position while such installation or machining is carried out. Otherwise, the locking mechanism 78 may be used to lock the turntable 62 between the pre-set increments (e.g., every 45°).

Figure 8:
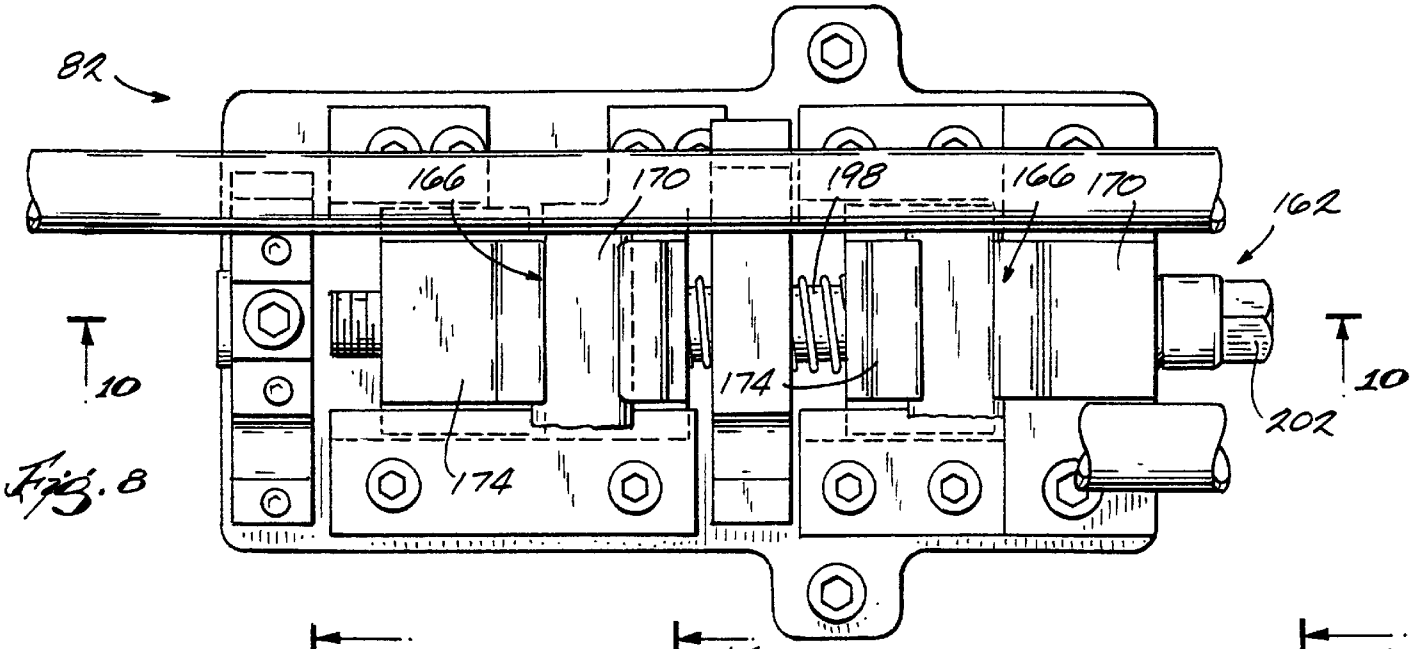
FIG. 8 is a top plan view of a first clamp-actuating mechanism.
Figure 9:
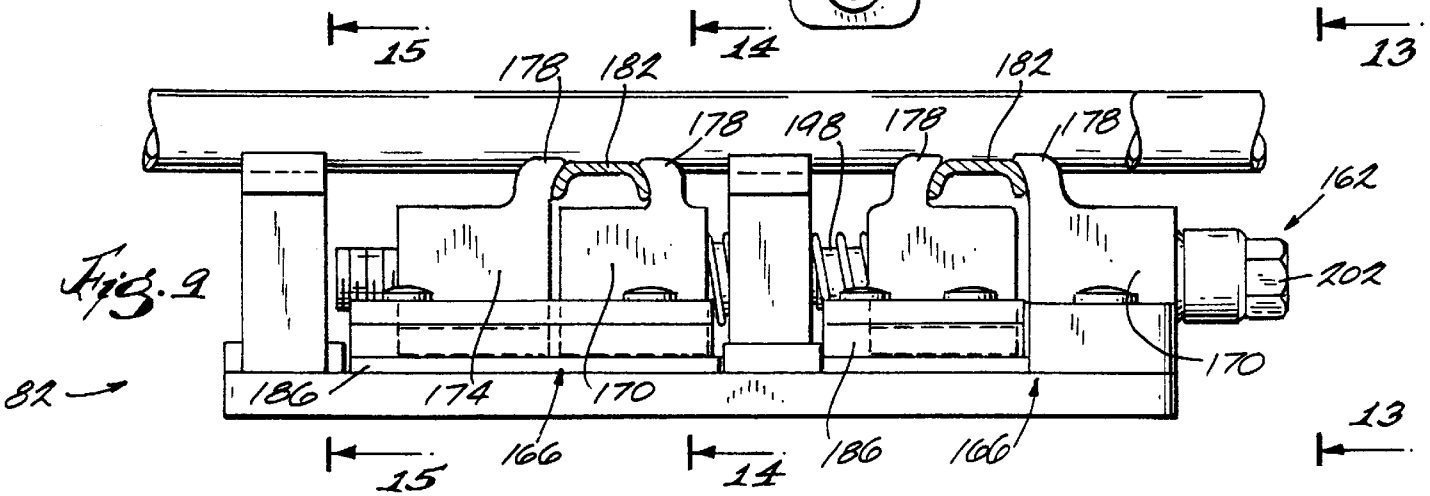
FIG. 9 is a side elevational view of the first clamp-actuating mechanism.
Figure 10:
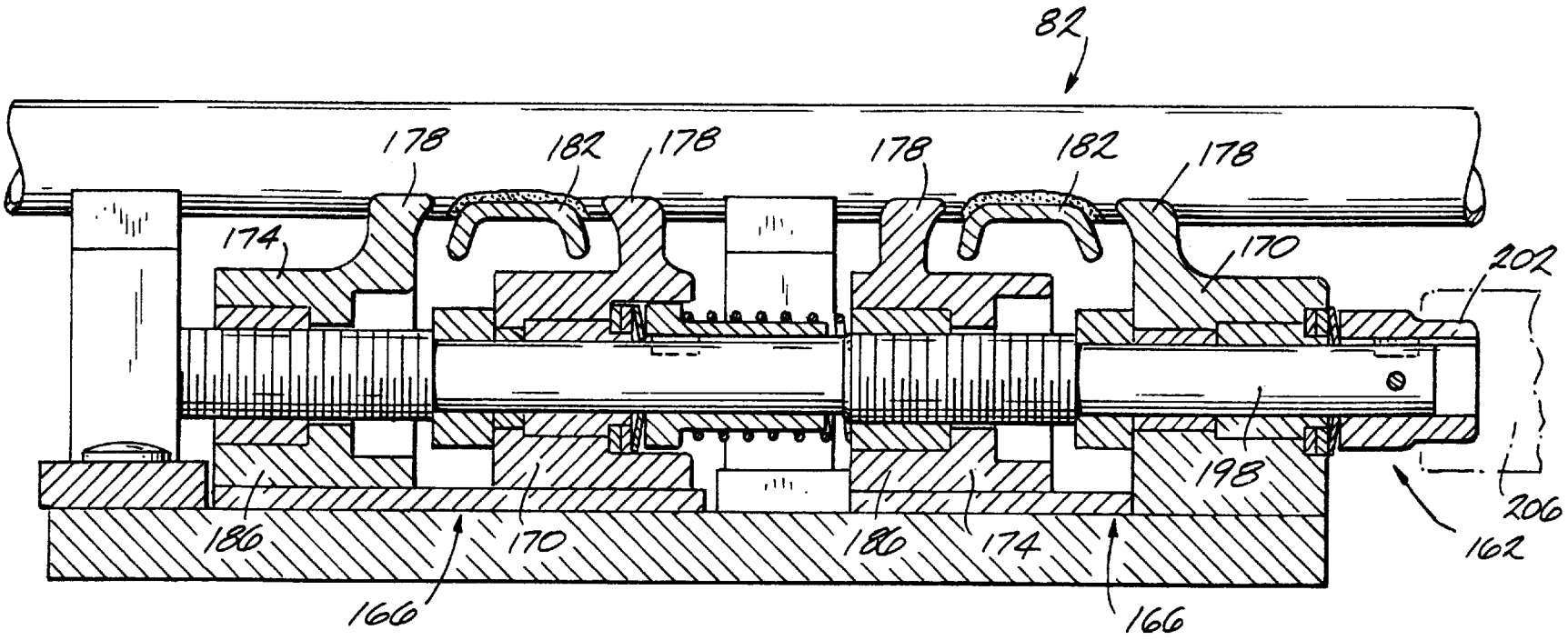
FIG. 10 is a cross-section view taken along line 10—10 in FIG. 8.

The clamping mechanism 82 employing a first clamp-actuating mechanism 162 is illustrated in FIGS. 8–10. The illustrated clamping mechanism 82 includes a clamp 166 having a stationary member 170 and a movable member 174. The illustrated clamping mechanism 82 includes a pair of clamps 166. Both the stationary members 170 and the movable members 174 of each clamp 166 include abutment portions or jaws 178 that mirror the shape of a portion 182 of the apparatus 14 (e.g., a frame member of a motorcycle). When the movable members 174 are moved within slots 186 toward the stationary members 170, and into a clamping position illustrated in FIG. 9, the portion 182 of the apparatus 14 is snugly received between the abutment portions 178. The clamps 166 may also be moved into an opened position (FIG. 10) by moving the movable members 174 away from the stationary members 170. The portion 182 of the apparatus 14 is easily removed from the clamps 166 when the clamps 166 are in the opened position, but is firmly held in the clamps 166 when the clamps 166 are in the clamping position.

Figure 14:
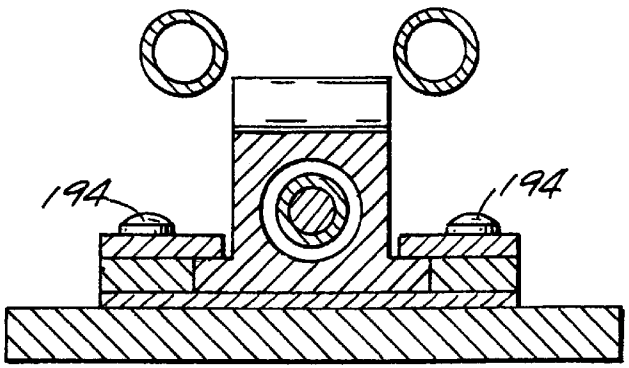
FIG. 14 is a cross-section view taken along line 14—14 in FIG. 9
Figure 13:
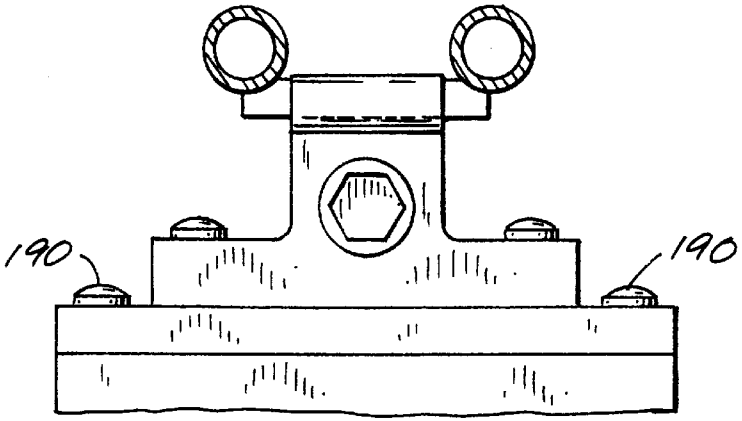
FIG. 13 is a view taken along line 13—13 in FIG. 9.
Figure 15:
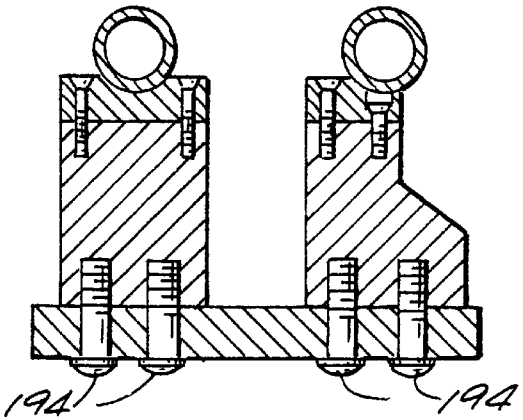
FIG. 15 is a cross-section view taken along line 15—15 in FIG. 9

Referring to FIGS. 13–15, the clamps 166 are mounted on the platform 46 of the elevator 30 by way of fasteners 190, such as bolts. Various components of the clamps 166 are also interconnected with fasteners 194, such as bolts.

The first clamp-actuating mechanism 162 includes a screw member 198 that passes through the stationary members 170 and the movable members 174 of the clamps 166. The portion of the screw member 198 passing through the stationary members 170 is a smooth shaft that passes through the stationary members 170 for rotation with respect to the stationary members 170. The portion of the screw member 198 passing through the movable members 174 is threaded, and mates with threads in the movable members 174. The illustrated screw member 198 includes a head portion 202 to facilitate rotation of the screw member 198 with a tool 206, such as an air tool. When the screw member 198 is rotated by the tool 206, the movable members 174 are caused to move between the opened position and the clamping position depending on the direction the screw member 198 is rotated. Alternatively, the portion of the shaft passing through the stationary members 170 may have reverse threads, and the stationary members 170 may be allowed to move within slots. In that case, rotation of the screw member 198 would cause both of the clamp members 170, 174 to move toward or away from each other. In another alternative, the movable members 174 may be pivoted between the opened position and the closed position instead of sliding.

Figures 11, 12:
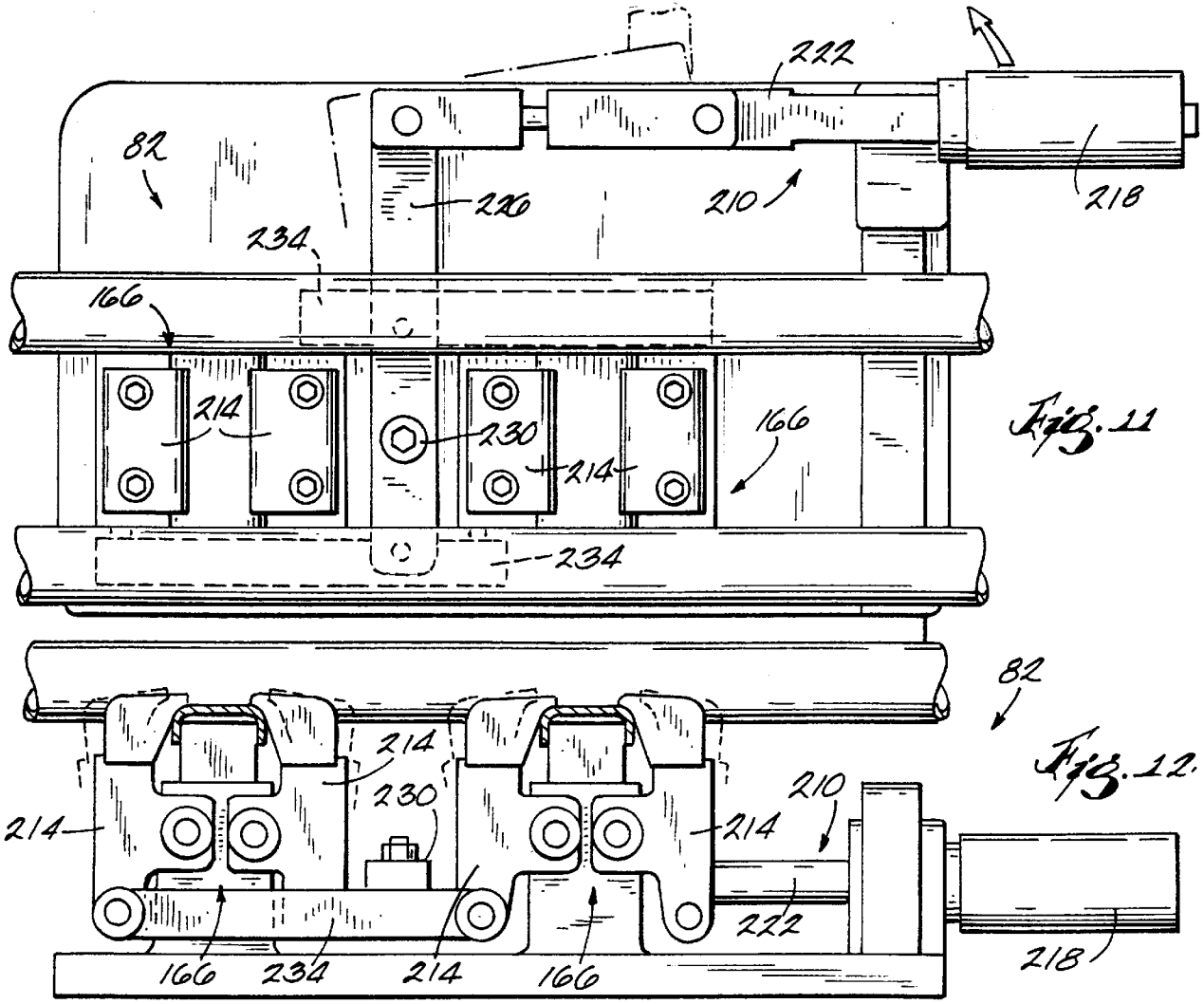
FIG. 11 is a top plan view of a second clamp-actuating mechanism.
FIG. 12 is a side elevational view of the second clamp-actuating mechanism.

A clamping mechanism 82 incorporating a second clamp-actuating mechanism 210 is illustrated in FIGS. 11 and 12. This clamping mechanism 82 also includes a pair of clamps 166. However, each of the illustrated clamps 166 includes a pair of movable members 214. The illustrated movable members 214 are pivoted about generally horizontal axes of rotation, but the movable members 214 may also be movable in slots for translation parallel to the tabletop 66. The second clamp-actuating mechanism 210 includes a handle 218 and a lever bar 222. The lever bar 222 is interconnected with a cross-member 226 that is pivotally mounted at a pivot point 230. A pair of generally parallel link members 234 are pivotally interconnected with the cross-member 226. Each link member 234 is also pivotally interconnected with one of the movable members 214 of each of the clamps 166. When the lever 218 is pivoted in the direction shown by the arrow in FIG. 11, the cross-member 226 pivots about the pivot point 230, causing the link members 234 to move in opposite directions, and causing the clamps 166 to move toward an open position or a clamping position with respect to the portion 182 of the apparatus 14.

Thus, for example, a fixture 10 incorporating either the first or second clamp-actuating mechanism 162, 210 can be used to easily clamp onto a motorcycle frame at one end of an assembly line. As the frame moves along the assembly line, parts of the motorcycle are added to the frame, with assembly workers being able to raise and lower the elevator 30, and rotate the turntable 62 about the axis of rotation 86. At the end of the line, a motorcycle has been built on the fixture 10. The motorcycle is easily removed by opening the clamps 166 with the first or second clamp-actuating mechanism 162, 210.

Although particular embodiments of the present invention have been shown and described, other alternative embodiments will be apparent to those skilled in the art and are within the intended scope of the present invention. Thus, the present invention is to be limited only by the following claims.

What is claimed is:

1. An assembly line fixture for the assembly of an apparatus, the fixture comprising:

an elevator having a platform, and operable to raise and lower the platform;

a turntable mounted on said platform for rotation with respect to said platform, said turntable having a tabletop and a skirt substantially surrounding a periphery of said tabletop, said skirt including a plurality of apertures at selected angular positions;

a locking mechanism interconnected with said platform and operable to selectively prevent said turntable from rotating with respect to said platform;

a clamping mechanism mounted on said turntable, said clamping mechanism including first and second clamp members, and a clamp-actuating mechanism operable to move said first clamp member toward said second clamp member to sandwich a portion of the apparatus between said first and second clamp members; and a detent mechanism interconnected with said platform and including a roller biased against said skirt such that when said turntable is rotated and said roller encounters one of said apertures, said turntable is retained at a known angle of rotation.

2. The fixture of claim 1, wherein said elevator is a scissors-leg table.

3. The fixture of claim 1, wherein said skirt depends from said tabletop between said tabletop and said platform.

4. The fixture of claim 1, wherein said locking mechanism includes a locking member and a biasing member, said biasing member biasing said locking member toward a locking position in which said turntable is prevented from rotation with respect to said platform.

5. The fixture of claim 4, wherein said skirt includes a plurality of notches, and wherein said locking member is received in at least one of said notches when said locking member is in said locking position.

6. The fixture of claim 4, wherein said locking mechanism includes a lever operably interconnected with said locking member to move said locking member from said locking position against the biasing force of said biasing member upon movement of said lever.

7. The fixture of claim 6, wherein said lever is an over-center lever, and wherein said lever is moveable between an up position in which the locking member is allowed to move into said locking position, and a down position in which said locking member is moved out of said locking position, said lever being adapted to remain in said down position against said biasing force of said biasing member.

8. The fixture of claim 1, wherein said clamp-actuating mechanism includes a screw member, and wherein said first clamp member is mounted on said screw member to travel along said screw member through a threaded interface between said screw member and said first clamp member.

9. The fixture of claim 1, wherein said clamp-actuating mechanism selectively causes both of said first and second clamp members to move toward each other.

10. The fixture of claim 1, wherein said first clamp member is slidable toward said second clamp member.

11. The fixture of claim 1, wherein said clamp-actuating mechanism includes a lever that causes said first clamp member to move when said lever is pivoted.

12. The fixture of claim 1, wherein said first clamp member is pivotable toward said second clamp member.

13. An assembly line fixture for the assembly of an apparatus, the fixture comprising:

an elevator having a platform, and operable to raise and lower the platform;

a turntable mounted on said platform for rotation with respect to said platform;

a locking mechanism including a locking member, a biasing member biasing said locking member toward a locking position in which said turntable is prevented from rotation with respect to said platform, and an over-center lever operably interconnected with said locking member to move said locking member from said locking position against the biasing force of said biasing member upon movement of said lever, said lever being moveable between a first position in which said locking member is allowed to move into said locking position, and a second position in which said locking member is moved out of said locking position, said lever being adapted to remain in said second position against said biasing force of said biasing member; and clamping mechanism mounted on said turntable, said clamping mechanism including first and second clamp members, and a clamp-actuating mechanism operable to move said first clamp member toward said second clamp member to sandwich a portion of the apparatus between said first and second clamp members.

14. The fixture of claim 13, wherein said clamp-actuating mechanism includes a screw member, and wherein said first clamp member is mounted on said screw member to travel along said screw member through a threaded interface between said screw member and said first clamp member.

15. The fixture of claim 13, wherein said clamp-actuating mechanism includes a lever that causes said first clamp member to move when said lever is pivoted.

16. The fixture of claim 13, wherein said clamp-actuating mechanism selectively causes both of said first and second clamp members to move toward each other.

17. An assembly line fixture for the assembly of an apparatus, the fixture comprising:

an elevator having a platform, and operable to raise and lower the platform;

a turntable mounted on said platform for rotation with respect to said platform;

a locking mechanism interconnected with said platform and operable to selectively prevent said turntable from rotating with respect to said platform; and a clamping mechanism including first and second clamp members and a threaded member, whereby rotation of said threaded member in a first direction causes said first clamp to travel along said threaded member toward said second clamp member to sandwich a portion of the apparatus to resist the removal of the portion of the apparatus from said clamp members, and whereby rotation of said threaded member in a second direction causes said first clamp to travel along said threaded member in a second direction to disengaged the portion of the apparatus.

* * * * *